US006241625B1

(12) United States Patent
Yokota et al.

(10) Patent No.: US 6,241,625 B1
(45) **Date of Patent: *Jun. 5, 2001**

(54) SOLID GOLF BALL

(75) Inventors: Masatoshi Yokota; Satoshi Iwami; Keiji Ohama, all of Akashi (JP)

(73) Assignee: Sumitomo Rubber Industries, Ltd., Hyogo-ken (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/461,814

(22) Filed: Dec. 16, 1999

(30) Foreign Application Priority Data

Dec. 18, 1998 (JP) ..... 10-361348

(51) Int. Cl.[7] ..... A63B 37/06
(52) U.S. Cl. ..... 473/373; 473/351
(58) Field of Search ..... 473/373, 374, 473/367, 368, 371, 372, 377, 378

(56) References Cited

U.S. PATENT DOCUMENTS

| | | | | |
|---|---|---|---|---|
| 4,556,220 | | 12/1985 | Tominaga et al. . | |
| 4,884,814 | | 12/1989 | Sullivan . | |
| 5,120,791 | | 6/1992 | Sullivan . | |
| 5,795,247 | * | 8/1998 | Yokota et al. | 473/374 |
| 5,919,101 | * | 7/1999 | Yokota et al. | 473/374 |
| 5,929,171 | * | 7/1999 | Sano et al. | 473/373 |

FOREIGN PATENT DOCUMENTS

| | | |
|---|---|---|
| 2297384 | 12/1990 | (JP) . |
| 4109970 | 4/1992 | (JP) . |
| 898901 | 4/1996 | (JP) . |
| 10179803 | 7/1998 | (JP) . |

* cited by examiner

*Primary Examiner*—Jeanette Chapman
*Assistant Examiner*—Raeann Gorden
(74) *Attorney, Agent, or Firm*—Birch, Stewart, Kolasch & Birch, LLP

(57) ABSTRACT

A golf ball has a cover member and a core member. The cover member contains: 3 to 30 parts by weight of a thermoplastic elastomer containing polyamide; 5 to 50 parts by weight of a terpolymer ionomer containing ethylene, (meth)acrylic acid, and (meth)acrylic ester; 30 to 80 parts by weight of a copolymer ionomer containing ethylene and (meth)acrylic acid; and 1 to 20 parts by weight of an epoxidized-diene-based block copolymer. The core member is formed by vulcanizing a rubber composition containing: 100 parts by weight of a base rubber, A parts by weight of an α, β-unsaturated carboxylic acid or a metal salt thereof, B parts by weight of an organic peroxide, and C parts by weight of a sulfide where A, B, and C satisfies the relationship:

$$0.02 \times A \leqq B+C \leqq 0.05 \times A,$$

and

A lies in the range from 25 to 45.

12 Claims, No Drawings

SOLID GOLF BALL

BACKGROUND OF THE INVENTION

1. Field of the Invention

The present invention relates to a golf ball, and more particularly to a solid golf ball having an improved shot feeling, resilience on shot and controllability.

2. Description of the Prior Art

Heretofore, balata rubber (natural rubber or synthetic transpolyisoprene rubber) or a mixture of balata rubber and elastomer has been used as a material for covers of so-called high-class golf balls. It is easier to put spin to golf balls having covers made of balata rubber because balata rubber is relatively soft and provides the golf balls with good controllability. Therefore, not only professional golfers but also non-professional but advanced golfers prefer the above type of golf balls. Since durability of balata rubber is rather small, the golf ball having the cover made of balata rubber has suffered from a problem that the golf ball may be broken or damaged when the golfer failed to hit the ball at a proper portion of the ball. Thus, it is highly likely that such a golf ball has a relatively short lifetime.

Recently, there has been widely used an ionomer which is a copolymer of α, β-unsaturated carboxylic acid and olefin as a material for a cover of a golf ball. Ionomer is superior to balata rubber in terms of durability and flight performance. However, the golf balls with the covers made of such ionomer have suffered from another problem that golfers have a difficulty in putting spin to the balls due to the hardness of ionomer, thus lowering controllability of the golf balls. Also, the hardness of ionomer leads to a poor shot feeling.

In order to improve controllability of the golf ball, Japanese Unexamined Patent Publication Nos. 1-308577 and 5-3931 disclose the idea of using ionomer mixture composed of a hard-type ionomer and a soft-type ionomer. This idea is effective in improving controllability and shot feeling of the golf ball but lowers resilience of the cover because the hardness of the cover decreases as a whole. Consequently, the resilience of the golf ball deteriorates, and the flying distance is lowered.

There has been proposed an idea of reducing the hardness of a core of the ball as well as the idea of reducing the hardness of the cover of the ball in order to improve the shot feeling. However, deterioration of the resilience of the ball as a whole is unavoidable also in the case where the hardness of the core is reduced for the same reason as applied above in the case where the hardness of the cover is reduced.

Also, there have been proposed various techniques of adding a variety of compounds as a material for the core to improve the resilience of the core, as disclosed in, for example, Japanese Examined Patent Publication Nos. 3-1335, 3-1336, 3-1337; and Japanese Unexamined Patent Publication Nos. 2-297384, 4-109970, 8-98901. None of them has proven to be effective in improving the resilience of the core of the ball.

As mentioned above, there has not been known a golf ball with a cover composed of ionomer which attains an improvement in shot feeling, controllability and resilience.

SUMMARY OF THE INVENTION

In view of the above, the present invention has been accomplished. An object of the present invention is to provide a golf ball with a cover made of ionomer which attains improved shot feeling, controllability and resilience.

According to an aspect of the present invention, a golf ball comprises a cover member and a core member. The cover member contains: 3 to 30 parts by weight of a thermoplastic elastomer containing polyamide; 5 to 50 parts by weight of a terpolymer ionomer containing ethylene, (meth)acrylic acid, and (meth)acrylic ester; 30 to 80 parts by weight of a copolymer ionomer containing ethylene and (meth)acrylic acid; and 1 to 20 parts by weight of an epoxidized-diene-based block copolymer. The core member is formed by vulcanizing a rubber composition containing: 100 parts by weight of a base rubber, A parts by weight of an α, β-unsaturated carboxylic acid or a metal salt thereof, B parts by weight of an organic peroxide, and C parts by weight of a sulfide, where A, B, and C satisfies the relationship:

$$0.02\times A \leqq B+C \leqq 0.05\times A,$$

and

A lies in the range from 25 to 45.

It should be noted that the term "(meth)acrylic" used throughout the specification indicates acrylic or methacrylic.

DETAILED DESCRIPTION OF THE INVENTION

Prior to filing this application, the present inventors found out the fact that forming a cover of a plurality of kinds of resins provides a golf ball with a good shot feeling, controllability and resilience, as a result of various experiments with an attempt to provide a golf ball having a cover made of ionomer with an improved shot feeling and controllability while maintaining an excellent durability and resilience. The inventors, however, have realized that the above golf ball still needs improvement because the above golf ball had an inferior resilience to those with the covers made of the conventional ionomer resins.

Accordingly, the present inventors have proceeded with further experiments by varying the ratio of each component composing the core in order to solve the above problem. As a result of the experiments, the present inventors found out that setting the ratio of each component of the core at such a value as to satisfy a certain relationship improves the resilience of the golf ball, and thus completed this invention.

A golf ball generally consists of a core member and a cover member. The cover member may consist of a single layer or a plurality of layers. In this embodiment, "cover" indicates the outermost layer constituting the cover member of the golf ball. For example, in the case where the golf ball has a single-layered cover member, the cover member corresponds to the cover in this embodiment, while in the case where the golf ball has a multi-layered cover member such as a 3-piece golf ball and 4-piece golf ball, the outermost layer of the cover member corresponds to the cover in this embodiment.

[Description of Cover]

First, components of a cover of a golf ball as a preferred embodiment of this invention are described. A primary feature of the cover used in this invention is that the cover contains 3 to 30 parts by weight of a thermoplastic elastomer having polyamide as a base material (hereinafter, also simply referred to as "elastomer"), 5 to 50 parts by weight of a terpolymer type ionomer containing ethylene, (meth)acrylic acid, and (meth)acrylic ester (hereinafter, also simply referred to as "terpolymer ionomer"), 30 to 80 parts by weight of a copolymer type ionomer containing ethylene and (meth)acrylic acid (hereinafter, also simply referred to as "copolymer ionomer"), and 1 to 20 parts by weight of an epoxidized diene-based block copolymer.

Specifically, copolymer ionomer has a great hardness and high resilience, and provides the cover with an improved hardness and resilience. In this state, however, the cover can not provide the resulting golf ball with a satisfactory shot feeling and controllability. Adding elastomer having a relatively small hardness and high resilience as a component constituting the cover improves the shot feeling and controllability of the resulting golf ball.

Further, in the case where the hardness of the golf ball is not so highly expected, that is, production of golf balls with substantially the same degree of hardness as the conventional golf balls composed of terpolymer ionomer and copolymer ionomer is expected, it is possible to provide the golf balls with a higher resilience by adding a larger amount of copolymer ionomer than the case of producing golf balls excellent both in hardness and resilience. Adding terpolymer ionomer having a relatively low resilience and low hardness as a component for the cover provides the resulting golf ball with a good shot feeling and controllability.

Terpolymer ionomer exhibits compatibility with elastomer. However, merely adding terpolymer ionomer does not accomplish a desired compatibility of terpolymer ionomer and elastomer. Accordingly, epoxidized diene-based block copolymer is added as a compatibilizer which is dissolvable both in ionomer and elastomer. Adding the above resins each with a certain amount provides a golf ball with a satisfactory shot feeling and controllability and improved resilience (namely, desired performance of the golf ball).

Next, the above resins are described one by one. First, elastomer is described. It is necessary to add 3 to 30 parts by weight of an elastomer. It is preferable to add 5 to 25 parts by weight of an elastomer. If the amount of an elastomer is smaller than 3 parts by weight, the resultant golf ball does not exhibit the above-mentioned performance (shot feeling, controllability and resilience) at a desired level. On the contrary, if the amount is greater than 30 parts by weight, compatibility of elastomer with ionomer is lowered, thus lowering the durability of the cover. Also, working efficiency during the golf ball production process is lowered.

It is preferable to set Shore D hardness of the cover in the range from 20 to 50 provided that the cover be merely composed of an elastomer. More preferable range of Shore D hardness is 20 to 40. If Shore D hardness is smaller than 20, it is required to reduce the amount of an elastomer in order to achieve a desired degree of hardness as the cover. This may lead to a failure in achieving a desired level of the above-mentioned performance as the golf ball. On the contrary, if Shore D hardness is larger than 50, it is highly likely that a satisfactory shot feeling and controllability are not achievable. Shore D hardness was measured by using a spring type Shore D hardness tester according to ASTM-D 2240. The hardness of the cover merely composed of a terpolymer ionomer was measured in a similar manner as that of the cover merely composed of an elastomer. Likewise, the hardness of the cover merely composed of a copolymer ionomer was measured in a similar manner as that of the cover merely composed of an elastomer.

Elastomer is a thermoplastic elastomer having a portion called "hard segment" and a portion called "soft segment" in a molecule thereof in which the hard segment contains polyamide therein. An example of the elastomer is the one sold under the trade name "PEBAX" (manufactured by Toray Co., Ltd.).

Next, terpolymer ionomer is described. It is preferable to add 5 to 50 parts by weight, and more preferable to add 5 to 40 parts by weight of a terpolymer ionomer. If the amount of a terpolymer ionomer is smaller than 5 parts by weight, the resultant cover is likely to have an excessive hardness, resulting in poor shot feeling of the golf ball. In addition, compatibility is lowered, thus lowering durability of the cover. Further, working efficiency during the golf ball production process is lowered. On the contrary, if the amount is larger than 50 parts by weight, the cover does not have a sufficient hardness, leading to a lowered resilience of the resultant golf ball.

It is preferable to set Shore D hardness of the cover in the range from 20 to 58 provided that the cover be merely composed of terpolymer ionomer. More preferable range of Shore D hardness is 30 to 55. If Shore D hardness is smaller than 20, the resilience of the cover is lowered. On the contrary, if Shore D hardness is larger than 58, it is highly likely that the resultant golf ball may have an excessive hardness, resulting in poor shot feeling.

Terpolymer ionomer usable in this invention is not limited to any specific kind, as far as ethylene-(meth)acrylic acid-(meth)acrylic ester terpolymer ionomer is used. Examples of ester group include methyl group, ethyl group, n-butyl group, i-butyl group, t-butyl group, and n-propyl group. Examples of a metal ion for neutralizing a carboxyl group include alkali metal ions such as Na ion, K ion and Li ion; bivalent ions such as Zn ion, Ca ion and Mg ion; and trivalent ions such as Al ion and Nd ion. These metal ions may be used alone or in combination of two or more kinds thereof. Na ion, Zn ion and Mg ion among these metal ions are particularly preferred to enhance the durability and resilience of the cover.

The amount of each monomer of ethylene, (meth)acrylic acid and (meth)acrylic ester in the terpolymer ionomer is not limited to a specific value. However, it may be preferable to add 20 to 90% by weight of ethylene; 5 to 30% by weight of (meth)acrylic acid; and 5 to 50% by weight of (meth) acrylic ester.

Specific examples of preferred terpolymer ionomer include SURLYN AD8542, and SURLYN AD8320 (trade names: manufactured by Du Pont Co.); HIMILAN 1855, HIMILAN AM7316, and HIMILAN 1856 (trade names: manufactured by Mitsui Du Pont Polychemical Co.); and IOTEC 7510 and IOTEC 7520 (trade names: manufactured by Exxon Co.), but are not limited thereto.

Next, copolymer ionomer is described. It is preferable to add 30 to 80 parts by weight, and more preferable to add 40 to 70 parts by weight of a copolymer ionomer. If the amount of a copolymer ionomer is smaller than 30 parts by weight, the resultant cover does not have a sufficient hardness, which may likely to produce a golf ball with a lowered resilience. On the contrary, if the amount is larger than 80 parts by weight, the cover is likely to have an excessive hardness, resulting in poor shot feeling of the golf ball.

It is preferable to set Shore D hardness of the cover in the range from 50 to 70 provided that the cover be merely composed of a copolymer ionomer. More preferable range of Shore D hardness is 55 to 65. If Shore D hardness is smaller than 50, the resilience of the cover is lowered. On the contrary, if Shore D hardness is larger than 70, it is highly likely that the resultant golf ball may have an excessive hardness, resulting in poor shot feeling.

Copolymer ionomer usable in this invention is not limited to any specific kind, as far as ethylene-(meth)acrylic acid copolymer type ionomer is used. Examples of a metal ion for neutralizing a carboxyl group include the aforementioned ions that have been exemplified in the description of terpolymer ionomer. These metal ions may be used alone or in combination of two or more kinds thereof. The amount of each monomer of ethylene and (meth)acrylic acid in the copolymer ionomer is not limited to a specific value. However, it may be preferable to contain 70 to 95% by weight of ethylene in the copolymer ionomer.

Specific examples of preferred copolymer ionomer include HIMILAN 1555 and HIMILAN 1706 (trade names: manufactured by Mitsui Du Pont Polychemical Co.); and IOTEC 8000 (trade name: manufactured by Exxon Co.), but are not limited thereto.

Now, epoxidized diene-based block copolymer is described. It is preferable to add 1 to 20 parts by weight, and more preferable to add 3 to 15 parts by weight of an epoxidized diene-based block copolymer. If the amount of an epoxidized diene-based block copolymer is smaller than 1 part by weight, compatibility of ionomer and elastomer is deteriorated, which lowers the durability of the cover and working efficiency during the golf ball production process. On the contrary, if the amount is larger than 20 parts by weight, it is likely that the cover may have a lowered resilience.

Epoxidized diene-based block copolymer is a copolymer obtained by epoxidizing a double-bond derived from a conjugated diene compound constituting a block copolymer or a partially hydrogenated block copolymer. Block copolymer as a base component in this embodiment is a copolymer essentially consisting of a polymer block A containing at least one kind of vinyl aromatic compound as a main component and a polymer block B containing at least one kind of conjugated diene compound as a main component. Hydrogenated block copolymer is obtained by hydrogenating the above block copolymer.

One or more kinds of styrene, α-methylstyrene, vinyltoluene, p-t-butylstyrene, 1,1-diphenylethylene may be selected as an example of vinyl aromatic compound constituting the block copolymer. Among these, styrene is particularly preferred.

One or more kinds of butadiene, isoprene, 1,3-pentadiene, 2,3-dimethyl-1,3-butadiene may be selected as a conjugated diene compound. Among these, butadiene, isoprene, or a combination thereof is preferred. Specific examples of the epoxidized diene-based block copolymer include the one sold under the trade name "EPOFRIEND" manufactured by Daicel Chemical Industries, Ltd.

The cover in which the above-mentioned resins are contained as main components may include, if the need arises to do so, fillers such as barium sulfate, colorants such as titanium dioxide, dispersants, antioxidants, ultraviolet absorbers, photostabilizers, fluorescent agents and fluorescent brighteners in a proper amount.

As mentioned above, the cover in this embodiment corresponds to the outermost layer constituting a cover member of a golf ball in the case where the golf ball is of a multi-layered type such as a 3-piece golf ball and 4-piece golf ball. The thickness of the cover is not limited to any specific value, but 1.2 to 2.3 mm in thickness is preferred. If the thickness is smaller than 1.2 mm, the cover member of the golf ball as a whole does not exhibit the property inherent thereto. On the contrary, if the thickness is greater than 2.3 mm, the thick cover member obstructs the core member from exhibiting the property inherent to the core member.

It is preferable to set Shore D hardness of the cover member in the range from 45 to 60. If Shore D hardness is smaller than 45, it is likely that the resilience of the cover member may be insufficient. On the contrary, if Shore D hardness is larger than 60, the resultant golf ball may provide a golfer with a poor shot feeling. Shore D hardness of the cover member was measured by measuring the hardness of the outermost surface of the golf ball having the cover manufactured according to this invention by using a spring type Shore D hardness tester.

[Description of Core]

Next, a core member used in this invention is described. Similar to the cover member, the core member may have a single-layered structure (namely, simply made of a core), or a multi-layered structure consisting of a center core corresponding to an innermost part of the core member and a plurality of layers. In this embodiment, any layer consisting of the multi-layered core member including the center core, as well as the core of the single-layered core member is referred to as "core".

The core is formed by vulcanizing a rubber composition containing a base rubber, an α, β-unsaturated carboxylic acid or a metal salt thereof, an organic peroxide, and a sulfide. The core according to this invention contains, in addition to a base rubber, components which satisfy the following relationship (I):

$$0.02\times A \leqq B+C \leqq 0.05\times A \quad \text{(I)}$$

where A represents the amount of an α, β-unsaturated carboxylic acid or a metal salt thereof in the range from 25 to 45; B represents the amount of an organic peroxide; and C represents the amount of a sulfide based on 100 parts by weight of a base rubber (unit: parts by weight).

As mentioned above, the core is formed by vulcanizing a rubber composition containing a base rubber, an α, β-unsaturated carboxylic acid or a metal salt thereof, an organic peroxide, and a sulfide.

As the base rubber, natural rubber or synthetic rubber which have been conventionally used in solid golf balls is used. Preferred is a so-called high-cis polybutadiene rubber having a cis-1,4-bond of not less than 40%, more preferred is a cis-1,4-bond of not less than 80%, because polybutadiene having higher amount of the cis-1,4-bond can provide a vulcanized rubber having higher resilience. The other rubber, such as natural rubber, isoprene rubber, styrene-butadiene rubber, ethylene propylene rubber and the like may be mixed with polybutadiene rubber.

The organic peroxide is used as a crosslinking initiator because the organic peroxide is dissociated by heat to be converted into radicals, which can enhance a crosslinking reaction between the α, β-unsaturated carboxylic acid or a metal salt thereof and the base rubber, thereby enhancing the resilience of the resulting solid golf ball. Good examples of the organic peroxide include dicumyl peroxide, 1,1-bis(t-butylperoxy)-3,3,5-trimethylcyclohexane, 2,5-dimethyl-2,5-di(t-butylperoxy)hexane, di-t-butyl peroxide and the like. Preferred is dicumyl peroxide.

The amount of the organic peroxide in the rubber composition is preferably 0.2 to 1.0 parts by weight per 100 parts by weight of the base rubber. When the amount of the organic peroxide is smaller than 0.2 parts by weight, the degree of crosslinking in the vulcanized rubber is insufficient to provide a solid golf ball having a high resilience. Thus, it is difficult to obtain a solid golf ball giving a satisfactory flying distance. On the other hand, when the amount of the organic peroxide exceeds 1.0 parts by weight, the amount of the α, β-unsaturated carboxylic acid should be smaller so as to provide the resultant core with a proper hardness. In this case, the resultant golf ball has an insufficient degree of crosslinking and insufficient resilience, resulting in reduced flying distance. In view of the above, more preferable lower limit is 0.3 parts by weight, while more preferable upper limit is 0.8 parts by weight.

The α, β-unsaturated carboxylic acid or a metal salt thereof is used as the co-crosslinking agent for vulcanization by peroxide, and an α, β-unsaturated carboxylic acid having 3 to 8 carbon atoms, such as acrylic acid and methacrylic acid, or a metal salt thereof is preferably used. The metal salt is a salt of bivalent or trivalent metal and is preferably zinc salt, magnesium salt or the like. A zinc acrylate or a zinc methacrylate is particularly preferred so as to impart excellent resilience to the resulting solid golf ball.

The amount of the α, β-unsaturated carboxylic acid or a metal salt thereof in the rubber composition is in the range from 25 to 45 parts by weight per 100 parts by weight of the base rubber. When the amount is smaller than 25 parts by weight, the hardness of the vulcanized rubber is insufficient to provide a solid golf ball having a high resilience, thereby reducing the flying distance of the resulting golf ball. On the other hand, when the amount is larger than 45 parts by weight, the vulcanized rubber is too hard to impart a satisfactory shot feeling to a solid golf ball. Preferable lower limit of the amount is 27 parts by weight and still more preferable lower limit is 29 parts by weight, while more preferable upper limit is 40 parts by weight and still more preferable upper limit is 36 parts by weight.

The sulfides in the rubber composition include diphenyl monosulfides represented by the following formula (1), diphenyl disulfides represented by the following formula (2), diphenyl polysulfides represented by the following formula (3), and morpholine disulfide represented by the following formula (4).

Formula (1)

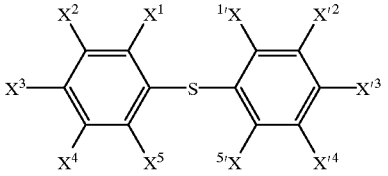

Formula (2)

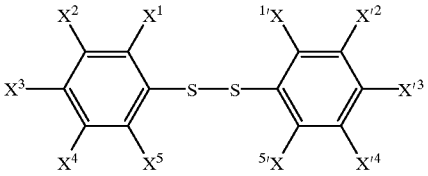

Formula (3)

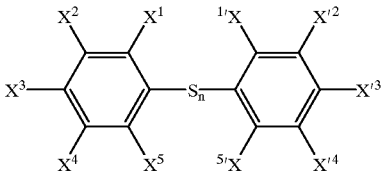

Formula (4)

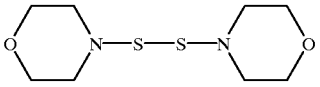

In the formulas (1) to (3), $X^1$ to $X^5$ and $X'^1$ to $X'^5$ are the same or different and each represents a halogen atom, an alkyl group, an acryloylthio group, a methacryloylthio group or a hydrogen atom. In addition, n in the formula (3) is an integer of 3 or 4.

The diphenyl monosulfides include dipheyl monosulfide wherein all of $X^1$ to $X^5$ and $X'^1$ to $X'^5$ are hydrogen atoms, symmetrical monosulfides (i.e. bis type), and asymmetrical monosulfides wherein $X^1$ to $X^5$ and $X'^1$ to $X'^5$ in correspondence each other are different. The diphenyl monosulfide and the bis type halogen-substituted phenyl monosulfide having a kind of halogen atom are preferably used. Examples of bis type halogen-substituted phenyl monosulfide having a kind of halogen atom include bis(fluorine-substituted phenyl) monosulfides such as bis(2-fluorophenyl) monosulfide, bis(2,5-difluorophenyl) monosulfide, bis(2,4,5-trifluorophenyl) monosulfide, bis(2,3,4,5-tetrafluorophenyl) monosulfide, and bis(pentafluorophenyl) monosulfide; bis(chlorine-substituted phenyl) monosulfides such as bis(2-chlorophenyl) monosulfide, bis(2,5-dichlorophenyl) monosulfide, bis(2,4,5-trichlorophenyl) monosulfide, bis(2,3,4,5-tetrachlorophenyl) monosulfide, and bis(pentachlorophenyl) monosulfide; and bis(bromine-substituted phenyl) monosulfides such as bis(2-bromophenyl) monosulfide, bis(2,5-dibromophenyl) monosulfide, bis(2,4,5-tribromophenyl) monosulfide, bis(2,3,4,5-tetrabromophenyl) monosulfide, and bis(pentabromophenyl) monosulfide. Bis type halogen-substituted phenyl monosulfide having two or more kinds of halogen atoms, bis(methacryloylthio-substituted phenyl) monosulfide, and bis(acryloylthio-substituted phenyl) monosulfide may be also used. Examples of bis type halogen-substituted phenyl monosulfide having two or more kinds of halogen atoms include bis(2-fluoro-5-chlorophenyl) monosulfide, bis(2-fluoro-5-bromophenyl) monosulfide, bis(2,4-difluoro-5-chlorophenyl) monosulfide, bis(2,4-difluoro-5-bromophenyl) monosulfide, bis(2,4-dichloro-5-bromophenyl) monosulfide, bis(2-fluoro-4-chloro-5-bromophenyl) monosulfide, bis(2,4-difluoro-3,5-dichlorophenyl) monosulfide and bis(2,4,5-trifluoro-3-chlorophenyl) monosulfide and the like. Examples of bis (methacryloylthio-substituted phenyl) monosulfide include bis(2-methacryloylthiophenyl) sulfide, bis(3-methacryloylthiophenyl) sulfide, and bis(4-methacryloylthiophenyl) sulfide. Examples of bis (acryloylthio-substituted phenyl) monosulfide include bis(2-acryloylthiophenyl) sulfide, bis(3-acryloylthiophenyl) sulfide, bis(4-acryloylthiophenyl) sulfide.

The diphenyl disulfides include dipheyl disulfide wherein all of $X^1$ to $X^5$ and $X'^1$ to $X'^5$ are hydrogen atoms, symmetrical disulfides (i.e. bis type), and asymmetrical disulfides wherein $X^1$ to $X^5$ and $X'^1$ to $X'^5$ in correspondence each other are different. Preferred is a diphenyl disulfide and a bis type halogen-substituted phenyl disulfide having a kind of halogen atom. The former is the most preferable because of low cost. Examples of bis type halogen-substituted phenyl disulfide having a kind of halogen atom include bis(fluorine-substituted phenyl) disulfides such as bis(2-fluorophenyl) disulfide, bis(2,5-difluorophenyl) disulfide, bis(2,4,5-trifluorophenyl) disulfide, bis(2,3,4,5-tetrafluorophenyl) disulfide, and bis(pentafluorophenyl) disulfide; bis(chlorine-substituted phenyl) disulfides such as bis(2-chlorophenyl) disulfide, bis(2,5-dichlorophenyl) disulfide, bis(2,4,5-trichlorophenyl) disulfide, bis(2,3,4,5-tetrachlorophenyl) disulfide, and bis(pentachlorophenyl) disulfide; and bis (bromine-substituted phenyl) disulfides such as bis(2-bromophenyl) disulfide, bis(2,5-dibromophenyl) disulfide, bis(2,4,5-tribromophenyl) disulfide, bis(2,3,4,5-tetrabromophenyl) disulfide, and bis(pentabromophenyl) disulfide. Examples of bis type halogen-substituted phenyl disulfide having two or more kinds of halogen atoms include bis(2-fluoro-5-chlorophenyl) disulfide, bis(2-fluoro-5-bromophenyl) disulfide, bis(2,4-difluoro-5-chlorophenyl) disulfide and bis(2,4-difluoro-5-bromophenyl) disulfide.

Examples of the diphenyl polysulfide include dibenzyl polysulfide, dibenzoyl polysulfide, dibenzothiazoyl polysulfide and dithiobenzoyl polysulfide.

The sulfide is liable to generate radicals by dissociation of a S—S bond or a C—S bond under heating. The radicals from the sulfide chemically act upon butadiene. In other words, it is conceived that generation of radicals imparts an influence to the crosslinking reaction between the base rubber and the α, β-unsaturated carboxylic acid in such a manner as to provide a vulcanized rubber with a high resilience, without undesirably increasing the hardness of the resultant core. Thus, a solid golf ball with an improved shot feeling is produced.

The amount of the sulfide in the rubber composition is preferably 0.2 to 1.0 parts by weight per 100 parts by weight of the base rubber. When the amount of the sulfide is smaller than 0.2 parts by weight, the vulcanized rubber shows no effect by adding the sulfide. When the amount exceeds 1.0 parts by weight, an influence on the organic peroxide becomes larger. An excessive influence of the sulfide on the organic peroxide provides the golf ball with a poor shot feeling despite a reduced hardness. Moreover, the resilience of the vulcanized rubber is decreased, resulting in decreasing the flying distance of the produced solid golf ball.

According to the present invention, when the amount of the α, β-unsaturated carboxylic acid or a metal salt thereof is A parts by weight, the amount of the organic peroxide is B parts by weight and the amount of the sulfide is C parts by weight, based on 100 parts by weight of the base rubber, the total amount of the organic peroxide and sulfide, i.e. "B+C" is 2.0% to 5.0% by weight based on the amount of the α, β-unsaturated carboxylic acid or a metal salt thereof. This relationship is represented as follows:

$$0.02\times A \leqq B+C \leqq 0.05\times A$$

Preferable lower limit is 2.5% by weight while preferable upper limit is 4.0% by weight, i.e. $0.025\times A \leqq B+C \leqq 0.04\times A$. More preferable lower limit is 3.0% by weight, while preferred upper limit is 4.0% by weight, i.e. $0.03\times A \leqq B+C \leqq 0.04\times A$.

When "B+C" is smaller than "0.02×A", the degree of crosslinking in the vulcanized rubber is insufficient to provide a solid golf ball having a high resilience and giving a long flying distance. When "B+C" is larger than "0.05×A" and "B" is larger than "C", the vulcanized rubber has too high a degree of crosslinking, and the hardness of the vulcanized rubber becomes too high. Thus, the resulting solid golf ball gives a golfer a poor shot feeling. When "B+C" is larger than "0.05×A" and "C" is larger than "B", the hardness of the vulcanized rubber becomes too low, resulting in reduced flying distance. Moreover, the resulting solid golf ball gives a poor shot feeling despite the reduced impact on shot because a large deformation of the ball on shot causes prolonged contact with a club head.

The rubber composition composing the core of the golf ball according to this invention may further contain, in addition to the above essential components, conventional additives such as specific gravity fillers, antioxidants, plasticizers, dispersants, ultraviolet absorbers, colorants and the like, if necessary. As the specific gravity filler, inorganic substances are widely used. Examples of specific gravity filler used in this invention include metal oxides and inorganic metal salts. Specifically, inorganic substances generally known as an inorganic filler such as zinc oxide, barium sulfate, and calcium carbonate may be used. Among these, zinc oxide is particularly preferred because it can function as a vulcanization activator in a vulcanization step which is described later. Zinc oxide is generally added to decrease the specific gravity of the golf ball.

Specific gravity fillers for increasing the specific gravity of the golf ball may be used as well as the specific gravity fillers for decreasing the specific gravity of the golf ball. The latter specific gravity fillers include metal powder, metal oxides and metal nitrides such as: metals including tungsten, molybdenum, lead, nickel, and copper; and an oxide, a carbide, and a nitride thereof.

The former (latter) specific gravity fillers may be used alone, or in combination of two or more kinds thereof. The specific gravity of a solid golf ball may also be adjusted by mixing the former specific gravity filler and the latter specific gravity filler at a proper ratio.

In this embodiment, the rubber composition having the above components is subjected to uniform kneading, put into a mold and heated under pressure for vulcanization, whereby a core is formed. It is a common practice to vulcanize the rubber composition at a temperature of 130 to 180° C. under a pressure of 30 to 100 kg/cm$^2$ for 15 to 60 minutes. However, the condition for vulcanization is not limited to the above.

In the case where the golf ball has the core member consisting of an innermost part (namely, center core) and a plurality of layers, the center core or at least one layer is made from the vulcanized rubber composition, preferably the center core, and more preferably the center core and all the layers are made from the vulcanized rubber composition.

An outer diameter of the core member (the core member including the outermost layer in the case of a multi-layered core member) preferably lies in the range from 32.0 to 40.5 mm, and more preferably from about 35.0 to 40.0 mm. This is because the solid golf ball comprising a core member having too small a diameter and hence a cover member having an excessively large thickness cannot effectively make use of excellent resilience of the core member. On the other hand, the solid golf ball comprising a core member having too large a diameter and hence a cover member having an excessively small thickness may result in a damage of the cover member when a great impact is exerted to the golf ball. In either way, the durability of the solid golf ball may be deteriorated if the outer diameter of the core member exceeds the above range.

According to the present invention, preferred is a core member having such a deformation amount of 2.7 mm to 3.3 mm when applied with a load ranging from 10 kgf as an initial load to 130 kgf as a final load, and more preferred deformation amount ranges from 2.8 to 3.2 mm.

When the deformation amount of the core member is smaller than 2.7 mm, the core member becomes too hard to give a good shot feeling. On the other hand, when the deformation amount is larger than 3.3 mm, the resilience of the core member is not sufficient to obtain a satisfactory flying distance.

The surface hardness of the core member of the golf ball according to the present invention is preferably from 75 to 90, and more preferably from 78 to 88 in terms of JIS-C hardness. It should be appreciated that the core member corresponds to a vulcanized rubber composition itself in the case of a single-layered core member. When the surface hardness of the core member is smaller than 75, the resulting solid golf ball has a low resilience. When the surface hardness of the core member is larger than 90, the resulting solid golf ball is poor in shot feeling because of an exceedingly hard core member.

A method for forming a solid golf ball by the thus produced cover member and core member is not limited to any specific method. It is possible to produce a solid golf ball with a cover member molded according to a well-known method. As an example, the composition composing the cover member is shaped into a hemispherical shell, two of the hemispherical-shaped shells (corresponding to a cover member) are jointed while enclosing a solid core member therein, and the thus assembled cover member and core member are molded into a spherical shape at a temperature of 130 to 170° C. for 1 to 15 minutes under pressure to produce a golf ball. Alternatively, the composition composing the cover member is directly subjected to injection molding around the core member in such a manner that the molded cover member entirely covers around the core member.

On cover molding, dimples or brambles may be formed on the surface of the cover member. After the cover molding, painting or marking is applied as necessary and, thus a golf ball available on the market is produced.

The thus produced solid golf ball according to this invention may preferably have the amount of deformation ranging from 2.4 to 3.5 mm when applied with a load ranging from 10 kgf as an initial load to 130 kgf as a final load. More preferably, the amount of deformation lies in the range from 2.7 to 3.3 mm. When the deformation amount is smaller than 2.4 mm, the hardness of the golf ball becomes too large which may give a golfer a poor shot feeling and controllability. On the other hand, when the deformation amount is larger than 3.5 mm, the hardness of the golf ball is lowered, which may likely result in a lowered resilience of the ball.

The surface hardness of the solid golf ball may preferably range from 70 to 90 in terms of JIS-C hardness. More preferable hardness is from 75 to 85. When the surface hardness is smaller than 70, the solid golf ball has a lower resilience. When the surface hardness is larger than 90, the solid golf ball may give a golfer a poor shot feeling and controllability.

EXAMPLE

The present invention is further illustrated by the following examples. It is to be understood that the present invention is not limited to the examples, and various changes and modifications may be made in the invention without departing from the spirit and scope thereof. Also, it should be noted that the unit of the amount for each component is parts by weight throughout Examples and Comparative Examples unless otherwise specified.

[Production of Core]

The components with respective amounts as the rubber composition for a core member in Table 1 were mixed, and the mixture was molded under heating at a temperature of 157° C. for 30 minutes to produce spherical cores 1 to 10. The deformation amount and JIS-C surface hardness of these cores 1 to 10 are also shown in Table 1.

It is to be noted that the deformation amount of each core was measured by applying a load ranging from 10 kgf as an initial load to 130 kgf as a final load to the core.

TABLE 1

| | Core Composition | | | | | | | | | |
|---|---|---|---|---|---|---|---|---|---|---|
| | 1 | 2 | 3 | 4 | 5 | 6 | 7 | 8 | 9 | 10 |
| BR-18 | 100 | 100 | 100 | 100 | 100 | 100 | 100 | 100 | 100 | 100 |
| Zinc acrylate: A | 32 | 27 | 32 | 32 | 37 | 27 | 22 | 32 | 32 | 32 |
| Dicumyl peroxide: B | 0.5 | 0.9 | 0.5 | 0.5 | 0.5 | 1.0 | 0.5 | 0.3 | 2.0 | 0.5 |
| Diphenyl disulfide: C | 0.5 | 0.5 | 0.3 | 0.8 | 0.9 | — | 0.5 | 0.2 | 0.5 | 1.5 |
| Zinc oxide | 17.3 | 19.2 | 17.2 | 17.5 | 15.8 | 18.8 | 21.0 | 17.1 | 17.5 | 18.1 |
| 0.02 × A | 0.64 | 0.54 | 0.64 | 0.64 | 0.74 | 0.54 | 0.44 | 0.64 | 0.64 | 0.64 |
| 0.05 × A | 1.60 | 1.35 | 1.60 | 1.60 | 1.85 | 1.35 | 1.10 | 1.60 | 1.60 | 1.60 |
| B + C | 1.0 | 0.9 | 0.8 | 1.3 | 1.4 | 1.0 | 1.0 | 0.5 | 2.5 | 2.0 |
| Deformation Amount (mm) | 2.9 | 3.2 | 2.8 | 3.2 | 2.7 | 2.8 | 3.8 | 3.0 | 2.5 | 3.5 |
| Surface Hardness (JIS-C) | 82 | 77 | 83 | 80 | 84 | 82 | 68 | 79 | 83 | 80 |

Note:
BR-18 is cis-1,4-polybutadiene, a product manufactured by Japan Synthetic Rubber Co. Ltd.

[Production of Cover Member]

The components with respective amounts shown in Tables 2 and 3 were mixed, titanium oxide was added to the mixture to adjust the specific gravity of the resultant cover member at 0.99, the admixture was kneaded by a twin worm extruder, and shaped into pellets of cover composition by a pelletizer. Covers 1 to 11 were made of the thus obtained pellets.

TABLE 2

| | Shore D | Cover Composition | | | | |
|---|---|---|---|---|---|---|
| | Hardness | 1 | 2 | 3 | 4 | 5 |
| Thermoplastic polyamide elastomer | | | | | | |
| PEBAX 2533SN00 | 25 | 10 | 15 | — | — | 10 |
| PEBAX 4033SN00 | 40 | — | — | 10 | 15 | — |
| Terpolymer ionomer | | | | | | |
| SURLYN AD 8542 | 44 | 20 | 20 | 20 | 20 | 20 |
| HIMILAN 1855 | 54 | — | — | — | — | — |
| Copolymer ionomer | | | | | | |
| HIMILAN 1555 | 57 | — | — | 60 | 50 | 30 |
| HIMILAN 1706 | 60 | 60 | 50 | — | — | 30 |
| Epoxidated diene-based block copolymer | | | | | | |
| EPOFRIEND A1010 | 28 | 10 | 15 | 10 | 15 | 10 |
| Shore D Hardness | | 55 | 51 | 55 | 52 | 5 4 |

TABLE 3

| | Shore D Hardness | Cover Composition 6 | 7 | 8 | 9 | 10 | 11 |
|---|---|---|---|---|---|---|---|
| Thermoplastic polyamide elastomer | | | | | | | |
| PEBAX 2533SN00 | 25 | — | — | — | 15 | 5 | — |
| PEBAX 4033SN00 | 40 | — | — | — | — | — | — |
| Terpolymer ionomer | | | | | | | |
| SURLYN AD8542 | 44 | — | — | — | 5 | 70 | 30 |
| HIMILAN 1855 | 54 | 95 | 50 | — | — | — | — |
| Copolymer ionomer | | | | | | | |
| HIMILAN 1555 | 57 | 5 | — | 50 | — | — | — |
| HIMILAN 1706 | 60 | — | 50 | 50 | 50 | 20 | 50 |
| Epoxidated diene-based block copolymer | | | | | | | |
| EPOFRIEND A1010 | 28 | — | — | — | 30 | 5 | 20 |
| Shore D Hardness | | 55 | 61 | 64 | 49 | 49 | 44 |

In Tables 2 and 3, PEBAX 2533 and PEBAX 4033 are trade names for a thermoplastic polyamide elastomer (manufactured by Toray Co., Ltd); SURLYN AD8542 is a trade name for an ethylene-acrylic acid copolymer ionomer neutralized with magnesium ion (manufactured by Du Pont Co.); HIMILAN 1855 is a trade name for an ethylene-acrylic acid-isobutyl acrylate terpolymer ionomer neutralized with zinc ion (manufactured by Mitsui Du Pont Polychemical Co.); HIMILAN 1555 is a trade name for an ethylene-acrylic acid copolymer ionomer neutralized with sodium ion (manufactured by Mitsui Du Pont Polychemical Co.); HIMILAN 1706 is a trade name for an ethylene-acrylic acid copolymer ionomer neutralized with zinc ion (manufactured by Mitsui Du Pont Polychemical Co.); and Epofriend A1010 is a trade name for a styrene elastomer which has polystyrene blocks (referred to as "S") and polybutadiene block (referred to as "B") in a link formation of S-B-S and is epoxidized (manufactured by Daicel Chemical Industries, Ltd.).

[Production of Golf Ball]

The cover composition (covers 1 to 11) was injection-molded onto the surface of the cores 1 to 10 to produce a cover member for a solid golf ball. Then, after deburring, preprocessing prior to painting, and painting, a golf ball of 42.7 mm in diameter and 45.4 g in weight was produced. The combination of the cores 1 to 10 and covers 1 to 11 is shown in Tables 4 and 5 along with the characteristic of each golf ball.

TABLE 4

| | Ex 1 | Ex 2 | Ex 3 | Ex 4 | Ex 5 | Ex 6 | Ex 7 | Ex 8 | Ex 9 |
|---|---|---|---|---|---|---|---|---|---|
| Core Type | Core 1 | Core 1 | Core 1 | Core 1 | Core 1 | Core 2 | Core 3 | Core 4 | Core 5 |
| Cover Type | Cover 1 | Cover 2 | Cover 3 | Cover 4 | Cover 5 | Cover 5 | Cover 5 | Cover 5 | Cover 5 |
| Deformation Amount (mm) | 2.6 | 2.7 | 2.5 | 2.5 | 2.6 | 2.9 | 2.5 | 2.9 | 2.4 |
| Surface Hardness (JIS-C) | 83 | 77 | 82 | 79 | 80 | 80 | 80 | 80 | 80 |
| Initial Ball Speed (ft/s) | 252 | 250 | 252 | 251 | 253 | 250 | 253 | 251 | 254 |
| Shot Feeling | ○ | ○ | ○ | ○ | ○ | ◎ | ○ | ◎ | ○ |
| Controllability | ○ | ◎ | ○ | ◎ | ○ | ○ | ○ | ○ | ○ |

Note:
Ex denotes Example.

TABLE 5

| | C Ex 1 | C Ex 2 | C Ex 3 | C Ex 4 | C Ex 5 | C Ex 6 | C Ex 7 | C Ex 8 | C Ex 9 | C Ex 10 | C Ex 11 |
|---|---|---|---|---|---|---|---|---|---|---|---|
| Core Type | Core 6 | Core 6 | Core 6 | Core 1 | Core 7 | Core 8 | Core 9 | Core 10 | Core 1 | Core 1 | Core 1 |
| Cover Type | Cover 6 | Cover 7 | Cover 8 | Cover 6 | Cover 5 | Cover 5 | Cover 5 | Cover 5 | Cover 9 | Cover 10 | Cover 11 |
| Deformation Amount (mm) | 2.5 | 2.4 | 2.4 | 2.6 | 3.4 | 2.7 | 2.2 | 3.2 | 2.7 | 2.7 | 2.9 |
| Surface Hardness (JIS-C) | 82 | 91 | 94 | 82 | 80 | 80 | 80 | 80 | 72 | 73 | 68 |
| Initial Ball Speed (ft/s) | 246 | 249 | 251 | 249 | 245 | 249 | 250 | 248 | 244 | 242 | 239 |
| Shot Feeling | Δ | X | X | Δ | Δ | Δ | Δ | Δ | Δ | Δ | X |
| Controllability | ○ | X | X | ○ | ○ | ○ | ○ | ○ | ○ | ○ | ○ |

Note:
C Ex denotes Comparative Example.

Each parameter for evaluating the golf ball shown in Tables 4 and 5 is described.

(1) Amount of Deformation

The deformation amount of each golf ball was measured when a load ranging from 10 kgf as an initial load to 130 kgf as a final load was exerted to the golf ball.

(2) Initial Ball Speed

The initial ball speed was calculated when an aluminum cylinder of 198.5 g hit each golf ball at a speed of 54.86 m/sec.

(3) Shot Feeling

Ten professional golfers hit each solid golf ball with a driver and they evaluated whether the shot feeling was excellent or not. The results were classified based on the following criteria.

◎: Eight to ten golfers evaluated the shot feeling satisfactory, and among them four or more golfers evaluated the shot feeling quite satisfactory.

○: Eight to ten golfers evaluated the shot feeling satisfactory.

Δ: Four to seven golfers evaluated the shot feeling satisfactory.

X: Three or less golfers evaluated the shot feeling satisfactory.

(4) Controllability

Ten professional golfers tried an approach shot of 30 yards with a sand wedge and they evaluated whether the shot feeling was excellent or not. The results were classified based on the following criteria.

◎: Eight to ten golfers evaluated the shot feeling satisfactory, and among them four or more golfers evaluated the shot feeling quite satisfactory.

○: Eight to ten golfers evaluated the shot feeling satisfactory.

Δ: Four to seven golfers evaluated the shot feeling satisfactory.

X: Three or less golfers evaluated the shot feeling satisfactory.

[Evaluation]

The golf balls of Examples 1 to 9 have satisfactory initial ball speed, shot feeling, and controllability. On the other hand, Comparative Examples have the following drawbacks.

Comparative Example 1 (4) has a very slow initial ball speed of 246 m/sec (249 m/sec), although the soft cover 6 gives the golf ball with a moderately satisfactory shot feeling and controllability. This is because the cover 6 does not contain a thermoplastic polyamide elastomer and contains a large amount (95 parts by weight) of a terpolymer ionomer and a small amount (5 parts by weight) of a copolymer ionomer.

The golf ball of Comparative Example 2 has an inferior shot feeling and controllability with a slow initial ball speed of 249 m/sec with the cover 7 in which 50 parts by weight of a terpolymer ionomer and 50 parts by weight of a copolymer ionomer are contained with no thermoplastic polyamide elastomer and epoxidized diene-based block copolymer added.

The golf ball of Comparative Example 3 has the cover 8 merely composed of a copolymer ionomer. Therefore, the hardness of the golf ball is undesirably increased to thereby provide a golfer with an inferior shot feeling and controllability despite the improved initial ball speed.

The golf ball of Comparative Example 9 has the cover 9 in which a large amount (30 parts by weight) of an epoxidized diene-based block copolymer is contained. Therefore, the initial ball speed is as slow as 244 m/sec. The golf ball of Comparative Example 10 has a slow initial ball speed of 242 m/sec because the golf ball has the very soft cover 10 in which an exceedingly large amount (70 parts by weight) of a terpolymer ionomer beyond the upper limit defined in this embodiment and an exceedingly small amount (20 parts by weight) of a copolymer ionomer beyond the lower limit defined in this embodiment are contained.

Lastly, the golf ball of Comparative Example 11 has an inferior initial ball speed and shot feeling despite a good controllability because the cover 11 does not contain a thermoplastic polyamide elastomer at all.

To summarize the above, the solid golf ball according to this invention has an improved shot feeling and controllability while maintaining an excellent durability and resilience inherent to the cover composed of ionomer by forming the cover of a plurality of kinds of resins and adjusting the ratio of each component composing the core in such a manner as to satisfy a certain relationship.

The present invention has been described with reference to the preferred embodiments. Obviously, modifications and alterations will occur to others upon reading and understanding the proceeding detailed description. It is intended that the present invention be construed as including all such modifications and alterations insofar as they come within the scope of the attended claims or the equivalents thereof.

What is claimed is:

1. A golf ball comprising a cover member and a core member, wherein the cover member contains:

3 to 30 parts by weight of a thermoplastic elastomer containing polyamide;

5 to 50 parts by weight of a terpolymer ionomer containing ethylene, (meth)acrylic acid, and (meth) acrylic ester;

30 to 80 parts by weight of a copolymer ionomer containing ethylene and (meth)acrylic acid; and 1 to 20 parts by weight of an epoxidized-diene-based block copolymer; and the core member is formed by vulcanizing a rubber composition containing:

100 parts by weight of a base rubber,

A parts by weight of an α, β-unsaturated carboxylic acid or a metal salt thereof, B parts by weight of an organic peroxide, and C parts by weight of a sulfide, where A, B, and C satisfies the relationship:

$$0.02 \times A \leqq B+C \leqq 0.05 \times A,$$

and

A lies in the range from 25 to 45.

2. The golf ball according to claim 1, wherein the thermoplastic elastomer has a shore D hardness between 20 and 50, the terpolymer ionomer has a shore D hardness between 20 and 58, and the copolymer ionomer has a shore D hardness between 50 and 70.

3. The golf ball according to claim 1, wherein the cover member has a shore D hardness between 45 and 60.

4. The golf ball according to claim 1, wherein the sulfide is diphenyldisulfide.

5. The golf ball according to claim 1, wherein the golf ball has an amount of deformation ranging from 2.4 to 3.5 mm when applied with a load ranging from 10 kgf as an initial load to 130 kgf as a final load, and has a surface hardness between 70 to 90 in terms of JIS-C hardness.

6. The golf ball according to claim 2, wherein the cover member has a shore D hardness between 45 and 60.

7. The golf ball according to claim 2, wherein the sulfide is diphenyldisulfide.

8. The golf ball according to claim 2, wherein the golf ball has an amount of deformation ranging from 2.4 to 3.5 mm when applied with a load ranging from 10 kgf as an initial load to 130 kgf as a final load, and has a surface hardness between 70 to 90 in terms of JIS-C hardness.

9. The golf ball according to claim 3, wherein the sulfide is diphenyldisulfide.

10. The golf ball according to claim 3, wherein the golf ball has an amount of deformation ranging from 2.4 to 3.5 mm when applied with a load ranging from 10 kgf as an initial load to 130 kgf as a final load, and has a surface hardness between 70 to 90 in terms of JIS-C hardness.

11. The golf ball according to claim 4, wherein the golf ball has an amount of deformation ranging from 2.4 to 3.5 mm when applied with a load ranging from 10 kgf as an initial load to 130 kgf as a final load, and has a surface hardness between 70 to 90 in terms of JIS-C hardness.

12. A golf ball according to claim 1, further comprising a cover member wherein:

B lies in the range from 0.2 to 1.0 parts by weight, and

C lies in the range from 0.2 to 1.0 parts by weight.

* * * * *